US005641150A

United States Patent [19]

Rober

[11] Patent Number: 5,641,150

[45] Date of Patent: Jun. 24, 1997

[54] TILTING LIFT APPARATUS

[75] Inventor: Dennis J. Rober, Maumee, Ohio

[73] Assignee: Tilt-Tech Corp., Maumee, Ohio

[21] Appl. No.: 442,028

[22] Filed: May 16, 1995

[51] Int. Cl.[6] ..... E02C 3/00

[52] U.S. Cl. ..... 254/88

[58] Field of Search ..... 254/3 R, 3 B, 254/3 C, 5 R, 5 B, 5 C, 88, 89 H, 90, DIG. 9, 93 R

[56] References Cited

U.S. PATENT DOCUMENTS

| | | | |
|---|---|---|---|
| 1,263,954 | 4/1918 | Sollender | 254/88 |
| 1,265,688 | 5/1918 | Lively | 254/88 |
| 1,477,332 | 12/1923 | Elzey | 254/88 |
| 1,820,267 | 8/1931 | Box | 254/88 |
| 2,556,929 | 6/1951 | Mervine | 254/88 |
| 3,190,395 | 6/1965 | Lill | 254/88 |
| 3,294,367 | 12/1966 | Liskey | 254/88 |
| 3,386,703 | 6/1968 | Thumma | 254/88 |
| 4,134,501 | 1/1979 | Tune | 214/1 A |
| 4,238,114 | 12/1980 | Migliorati | 254/88 |
| 4,420,054 | 12/1983 | Caris | 177/154 |
| 4,486,006 | 12/1984 | Fawdry | 254/88 |
| 5,015,146 | 5/1991 | Barnes et al. | 414/639 |
| 5,141,371 | 8/1992 | Pish | 254/88 |
| 5,197,714 | 3/1993 | Metzen | 254/126 |
| 5,203,153 | 4/1993 | Van Zee et al. | 56/341 |
| 5,236,065 | 8/1993 | Isogai | 187/8.41 |
| 5,253,973 | 10/1993 | Fretwell | 414/558 |
| 5,340,267 | 8/1994 | Stoll et al. | 414/537 |

*Primary Examiner*—Robert C. Watson
*Assistant Examiner*—Thomas W. Lynch
*Attorney, Agent, or Firm*—Emch, Schaffer, Schaub & Porcello

[57] ABSTRACT

A tilting lift apparatus for providing access to the under carriage of a vehicle, such as a fork lift truck is disclosed. A base pivotally mounts at least two longitudinally extending ramps. When a vehicle is moved onto the ramps they move from an angle position to a level position. A movement attenuating assembly is connected to the ramps for slowing their movement. In a preferred embodiment a tilter leg assembly is pivotally mounted together with a pivotally mounted brace. Both swing downwardly and engage as the ramps move toward the level position. A worker may then move under the ramps to perform maintenance or repair on the vehicle.

10 Claims, 6 Drawing Sheets

TILTING LIFT APPARATUS

DESCRIPTION

1. Background of the Invention

The present invention relates to a tilting lift apparatus which includes a pair of pivotable ramps onto which a vehicle, such as a fork lift truck can be moved. The ramps are initially in an angled position. When the truck moves past the pivot point, the ramps move downwardly to a level position. Tilting lifts are known in the prior art.

One problem in the prior art is the difficulty in limiting movement of the ramps as they move quickly downwardly as a result of the weight of the vehicle.

A second problem in the art is providing an effective rear support under the ramps after the rear end of the ramps have been moved upwardly to the level position.

The present invention is directed to an improved tilting lift apparatus which provides improved structures for dealing with the known problems in the art.

2. Summary of the Invention

The present invention is directed to a tilting lift apparatus which includes a base frame having a pivot shaft assembly. At least two longitudinally extending ramps are mounted on the pivot shaft assembly and are movable between an angle position and a generally level position. Each of the ramps has a fixed leg assembly at one end and a pivotable leg assembly at the other end. A movement attenuating assembly is operatively connected to the ramps for slowing the movement of each of the ramps during movement between said angle position and said generally level position.

In the preferred embodiment, the pivotable leg assembly comprises a tilter leg assembly together with a brace. The tilter leg assembly and the brace are pivotally mounted in spaced relation to one another. Both the tilter leg assembly and the brace swing downwardly and engage one another as the ramps move between the angle position and the level position.

DETAILED DESCRIPTION OF THE PREFERRED EMBODIMENT

Figure 1:
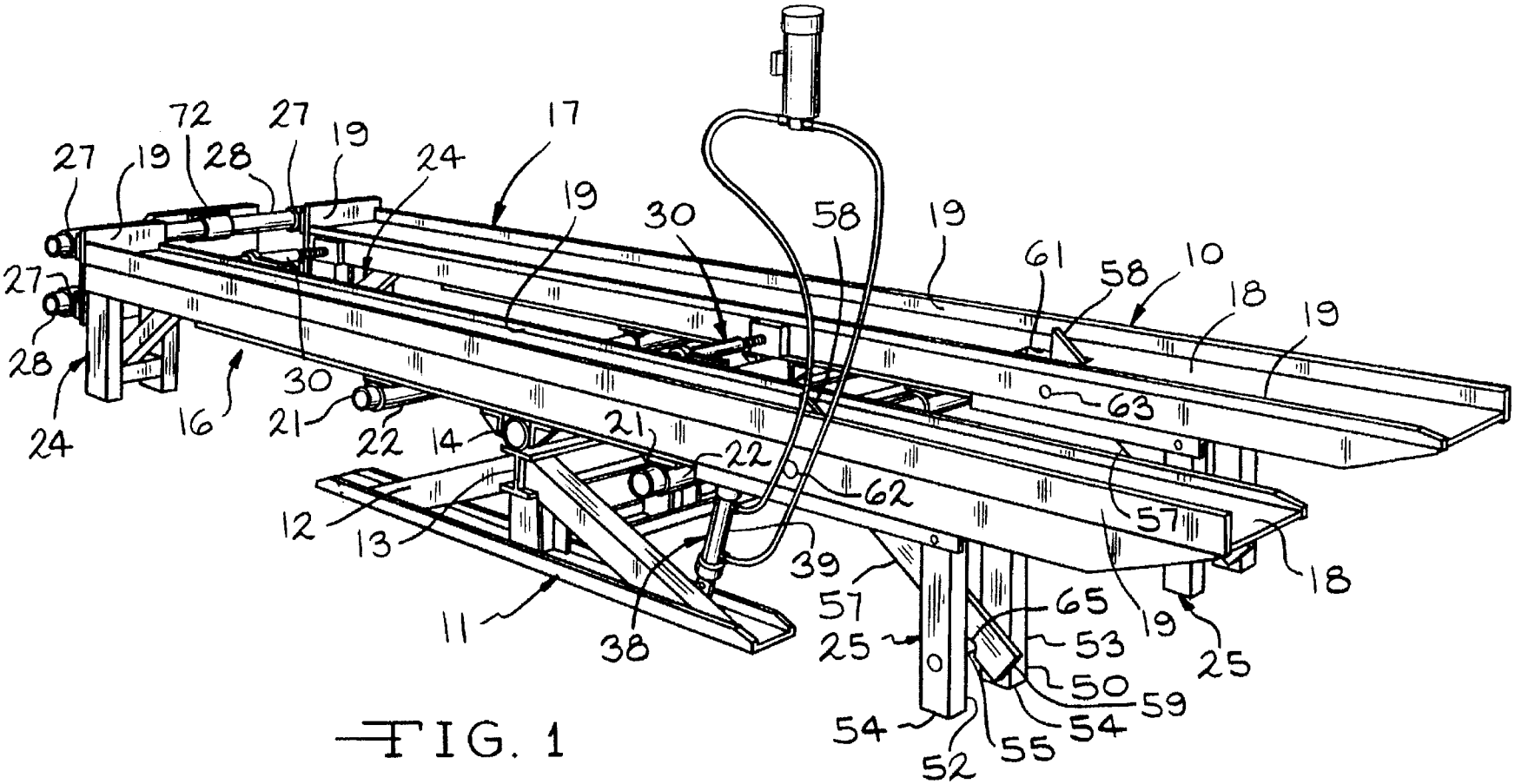
FIG. 1 is a perspective view of a tilting lift apparatus, according to the present invention, diagrammatically showing the movement attenuating assembly.

A tilting lift apparatus, according to the present invention, is generally indicated in the drawings by the reference number 10. The tilting lift apparatus 10 includes a base unit

11 having a pair of opposed side units 12 and a transverse cross beam 13 extending between the side units 12. A pivot shaft assembly 14 is mounted above the transverse cross beam 13. In the present embodiment, a pair of longitudinally extending ramps 16 and 17 are pivotally mounted on the shaft assembly 14. The longitudinally extending ramps 16 and 17 have an upper surface 18 and curb walls 19 on three sides.

In some embodiments (not shown) an additional ramp is positioned between the two ramps 16 and 17. This type of tilting lift apparatus is utilized to handle three-wheeled vehicles. The center ramp is positioned over the pivot shaft assembly 14 when required.

Figure 2:
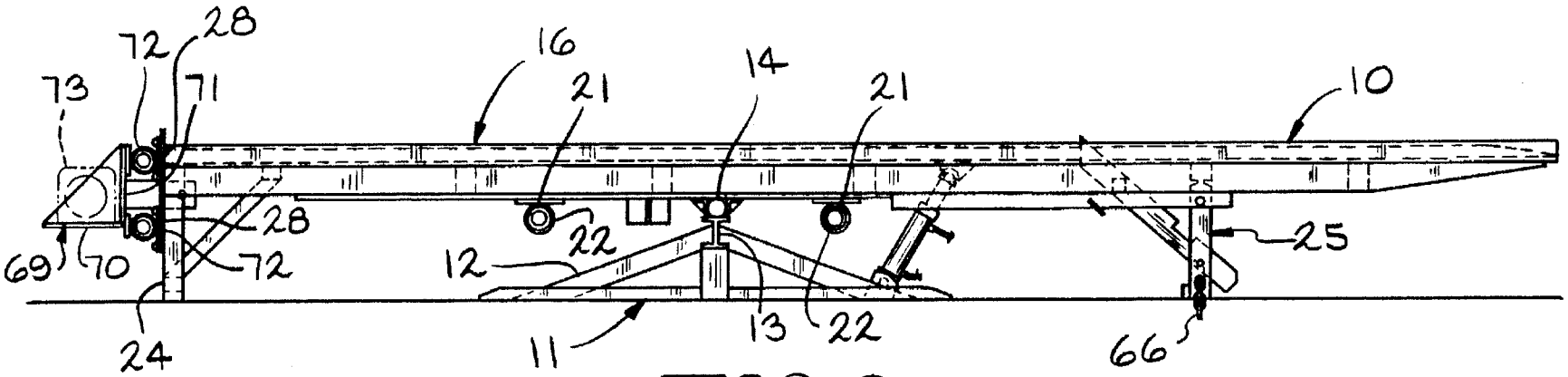
FIG. 2 is an elevational view of the tilting lift apparatus, shown in the generally level position.
Figure 3:
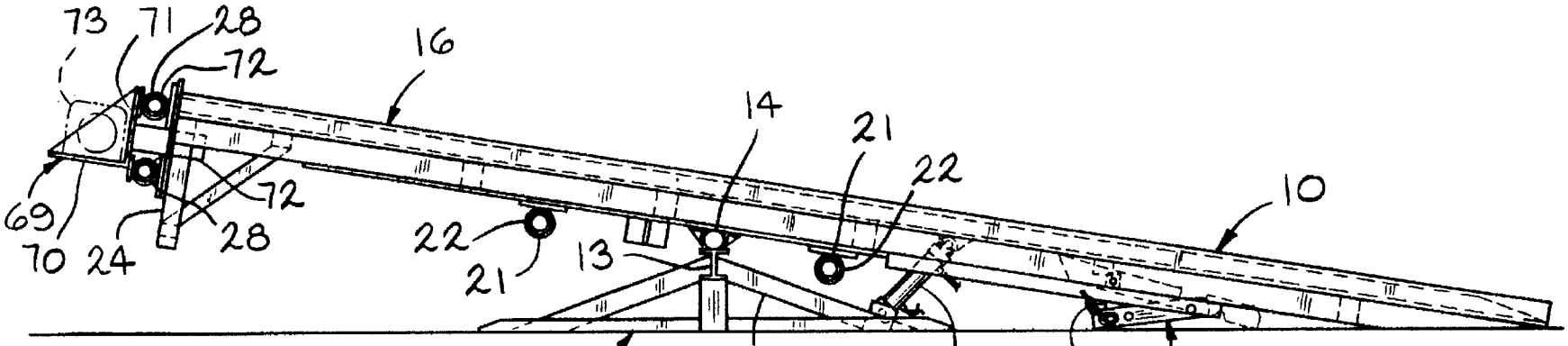
FIG. 3 is a view similar to FIG. 2 showing the tilting lift apparatus in the angle position.
Figure 5:
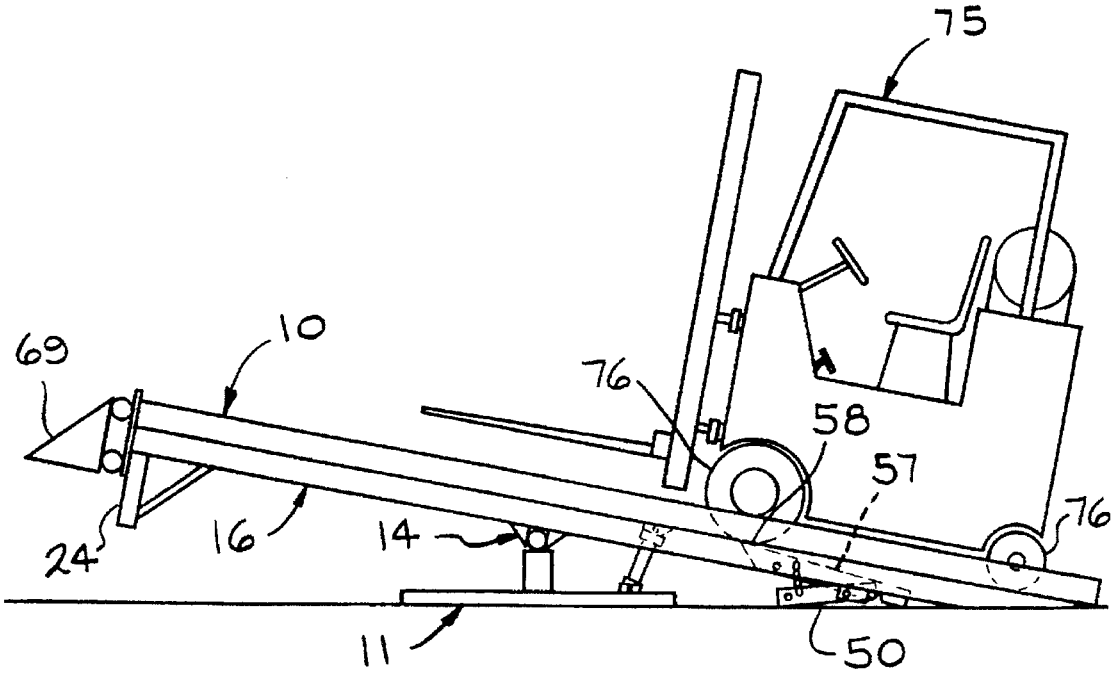
FIG. 5 is an elevational view, with parts removed for clarity, of a fork lift truck being moved upon the tilting lift apparatus.
Figure 7:
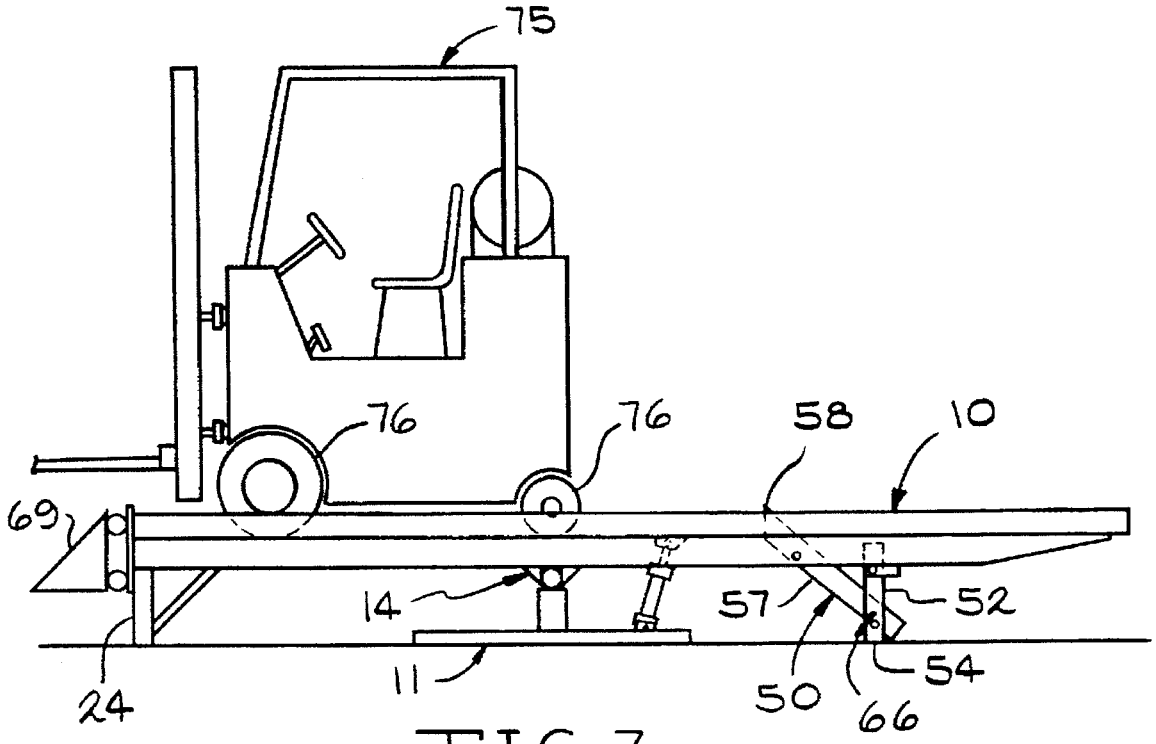
FIG. 7 is similar to FIG. 5 showing the tilting lift apparatus in the level position.

The two longitudinally extending ramps 16 and 17 are movable between an angle position shown in FIGS. 3 and 5 and a generally horizontal or level position shown in FIGS. 2 and 7. A plurality of cross members 21 are movably mounted within bearings 22. The cross members 21 are tubes which extend between the ramps 16 and 17 and provide reinforcing support. The bearings 22 are attached to the respective ramps 16 and 17. A fixed leg assembly 24 is mounted on one end, in this case the forward end, of each ramp 16 and 17. A pivotable leg assembly 25 is mounted on the other end of each of the ramps 16 and 17.

In the present embodiment, the first end or forward end of the ramps 16 and 17 mount bearings 27 which in turn mount cross members 28. In the present embodiment the cross members 28 are tubes. The ramps 16 and 17 are movable inwardly and outwardly relative to one another by the sliding of the respective cross members 21 and 28 within the respective bearings 22 and 27.

Figure 4:
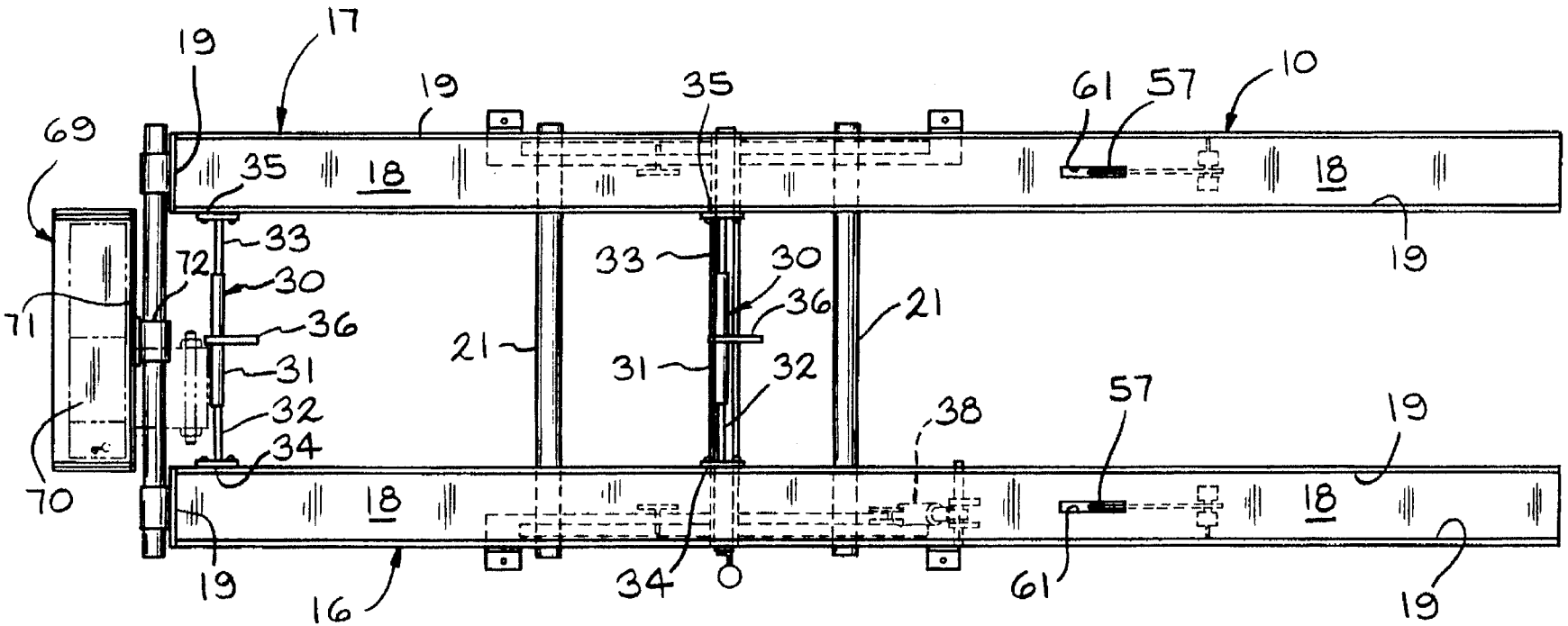
FIG. 4 is a plan view of the tilting lift apparatus.

Referring to FIGS. 1 and 4, adjusting assemblies 30 extend between the ramps 16 and 17 for adjusting the spacing of the ramps 16 and 17, relative to one another. The adjusting assemblies 30 include an internally threaded ratchet turnbuckle 31, which threadedly mounts a pair of threaded shafts 32 and 33. The threaded shafts 32 and 33 are connected to the ramps 16 and 17 by mounting blocks 34 and 35. A handle 36 is provided on the turnbuckle 31 for rotating the turnbuckle. Rotation of the handle 36 moves the ramps 16 and 17 either toward or away from one another, depending on the direction of rotation of the handle 33. This allows the tilting lift apparatus to service vehicles whose wheels have different spacings.

One key factor the present invention is a movement attenuating assembly 38 which is operatively connected to the ramps 16 and 17. In the present embodiment, the attenuating assembly 38 is connected between one of the side units 12 of the base unit 11 and the ramp 16. In other embodiments, movement attenuating assemblies 38 are provided on both the ramps 16 and 17. In the present context, the word "attenuating" means slowing. As the ramps 16 and 17 are moved from either the angle position to the level position or from the level position to the angle position, the movement attenuating assemblies 38 slow the pivotable movement of the ramps 16 and 17. This prevents the fixed leg assemblies 24 from slamming into the ground or floor.

Figure 8:
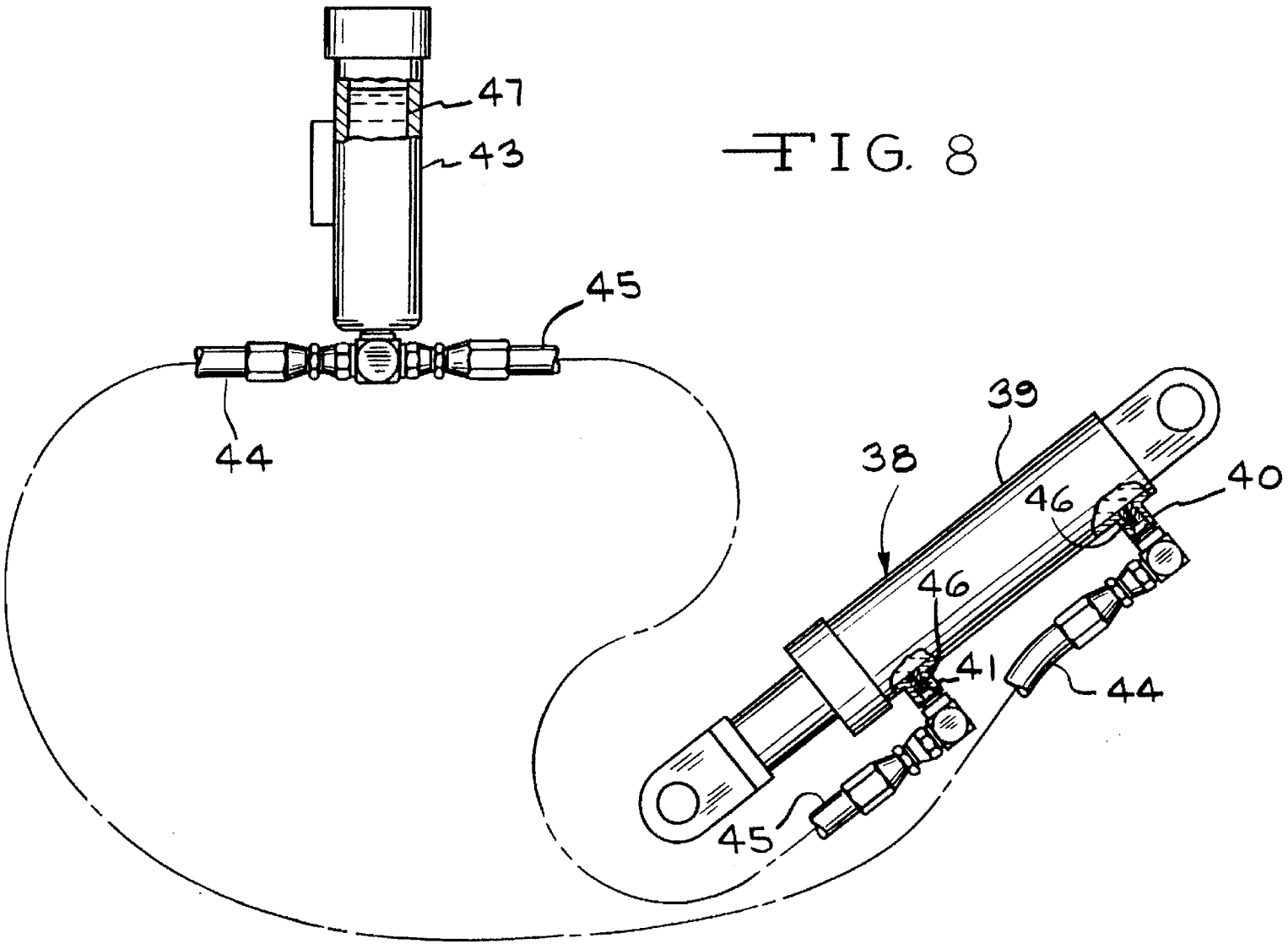
FIG. 8 is a diagrammatic view of the fluid circuit for the movement attenuating assembly.

Referring to FIG. 8, in the present embodiment, the movement attenuating assembly 38 includes a fluid cylinder 39 having an input 40 and an output 41. A fluid supply reservoir 43, in this case a gravity feed reservoir, is in fluid communication with the cylinder 39 through conduits 44 and 45. The input 40 includes a restrictive passageway or port 46. The output 41 also includes a restrictive passageway or port 46. When a force, such as the weight of a vehicle, is placed on the cylinder 39 one of the restrictive port 46, depending on the direction of travel of the vehicle, restricts fluid flow thereby slowing the movement of the ramps 16 and 17. Preferably the fluid 47 within the supply reservoir 43 is a hydraulic fluid.

The pivotable leg assembly 25, located adjacent the entrance end of the ramps 16 and 17, includes a tilter leg assembly 50 having an upper end 51 pivotally mounted to either the ramp 16 or the ramp 17. In the present embodiment, the tilter leg assembly 50 includes a pair of legs 52 and 53 having lower ground engaging ends 54. A lock bar 55 extends outwardly between the legs 52 and 53. The tilter leg assembly 50 also includes a pivotally mounted brace 57 having a first end 58 and a second end 59. In the preferred embodiment, the upper surface 18 of the ramps 16 and 17 include a slot 61 (see FIGS. 1 and 4). The first end 58 of the brace 57 is pivotally mounted by pivot pins 62 and 63 to the respective ramps 16 and 17. When the ramps 16 and 17 are in their generally level position, the first ends 58 of the brace 57 extend upwardly through the slots 61.

Each of the braces 57 define a notch 65 adjacent the second ends 59. When the ramps 16 and 17 are moved to the generally level position, the tilter leg assemblies 50 drop automatically to a vertical position and the notches 65 of the braces 57 receive the lock bars 55 of the tilter leg assemblies 50 to hold the support legs 52 and 53 in their vertical position. Referring to FIGS. 2 and 3, a chain 66 is provided adjacent the ends 54 of the tilter leg assembly 50. The chains 66 may be manually pulled to move the lock bars 55 from the notches 65 so that the brace 57 and the legs 52 and 53 may be swung to their collapsed position, as shown in FIG. 3.

Referring to FIGS. 1–3, a winch platform 69 having a bottom 70 and an upwardly extending back 71 is mounted between the ramps 16 and 17 adjacent the forward end of the ramps, in this particular embodiment, a pair of bearings 72 are welded to the back 71 and are mounted on the tube-shaped cross members 28. A winch 73 is indicated in FIGS. 2 and 3 and is positioned on the bottom 70 of the winch platform 69. The winch 73 is used to pull incapacitated vehicles to the desired position on the ramps 16 and 17.

The materials utilized in the tilting lift apparatus 10, illustrated in the drawings and described above, are constructed of various metals, with the majority of the materials being structural steel and sheet steel members.

Figure 6:
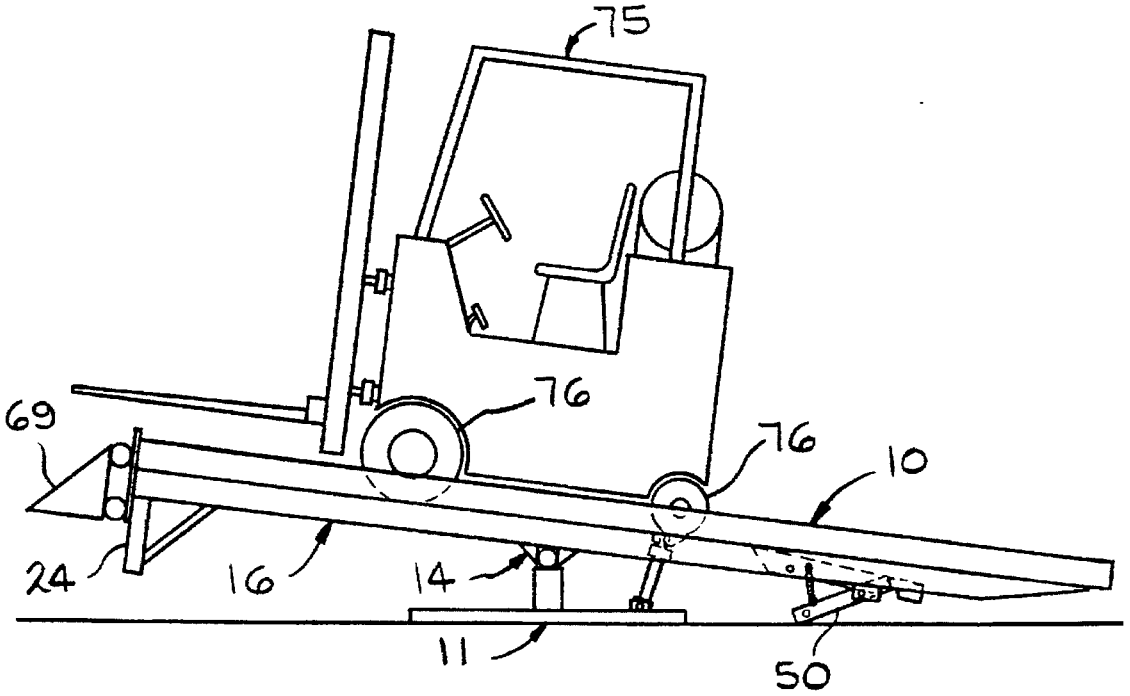
FIG. 6 is a view similar to FIG. 5 showing the vehicle moving past the pivot point and moving toward the level position.

FIGS. 5, 6 and 7 of the drawings illustrate a typical use of the tilting lift apparatus 10, according to the present invention. A fork lift truck 75 is shown being moved onto the tilting lift apparatus 10 for servicing. An important feature of the tilting lift apparatus 10 is that no power is required to operate the tilting lift apparatus 10. Initially, the adjusting assemblies 30 (see FIG. 1 ) have been activated by rotating the turnbuckles 30 to move the ramps 16 and 17 to the desired spacing, which accommodates the wheels of the fork lift truck 75. The tilting lift apparatus 10 is in the angle position and the truck 75 is driven or winched onto the ramps 16 and 17 with the curbs 19 restricting sideward movement. When in the angle position, the fixed leg assemblies 24 are in their permanently down position while the rear tilter leg assembly 50 is in the collapsed position. When in the collapsed position, the first ends 58 of the braces 57 are recessed and do not extend through the slots 61 within the upper surfaces 18 of the ramps 16 and 17, as shown in FIG. 1. This allows the wheels 76 of the fork lift truck 75 to pass along the ramps 16 and 17 without engaging the braces 57.

Referring to FIG. 6, as the weight of the fork lift truck 75 moves past the pivot shaft assembly 14 the front end of the ramps 16 and 17 begin to rotate downwardly and the tilter leg assembly 50 begins to rotate, under the force of gravity, into its locked position.

FIG. 7 illustrates the level position of the tilting lift apparatus 10. In this position, the weight of the fork lift truck 75 is forward of the pivot shaft assembly 14 and the fixed leg assemblies 24 are in the down, ground engaging position. The tilting lift apparatus 10 is now in its generally level position. The notches 65 of the braces 57 have received the lock bars 55 of the legs 52 and 53 to secure and lock the tilter leg assembly. When in this position, the ground engaging ends 54 of the legs 52 and 53 are closely adjacent the ground, but preferably slightly elevated. This aids in reversing the procedure and collapsing the tilter leg assembly 50 when the maintenance is completed and the chains 66 are grasped to collapse the tilter leg assembly 50. When in the FIG. 7 position, the first end 58 of the brace 57 extends upwardly through the slots 61 to retard the wheels 76 of the fork lift truck 75 from moving rearwardly unless the tilter leg assemblies 50 are collapsed.

Many revisions may be made to the tilting lift apparatus described above without departing from the scope of the present invention or from the following claims.

I claim:

1. Tilting lift apparatus comprising, a base unit having a pivot shaft assembly, at least two longitudinally extending ramps mounted on said pivot shaft assembly and movable between an angle position and a generally level position, each of said ramps having a fixed leg assembly at one end and a pivotal leg assembly at the other end, said pivotal leg assembly including a brace having a first end and a second end, said brace being pivotally mounted, one of same ramps defining a slot for receiving said first end of said brace when said pivotal leg assembly is moved to a vertical position, transverse cross members for connecting said ramps, and a movement attenuating assembly operatively connected to said ramps for slowing the movement of each of said ramps during movement between said angle position and said generally level position, said movement attenuating assembly including a cylinder connected to one of said ramps, said cylinder having an input and an output, a separate gravity feed fluid supply reservoir in liquid communication with said input and said output of said cylinder and a restrictive passageway communicating with said input and said output, whereby when a force is placed on said cylinder by movement of said ramps, fluid is restricted through said passageway thereby slowing the movement of said ramps.

2. Tilting lift apparatus, according to claim 1, wherein said base unit comprises a pair of spaced side units and a transverse cross beam extending between said side units, said pivot shaft assembly mounted above said transverse cross beam, said pivot shaft assembly mounting said longitudinally extending ramps.

3. Tilting lift apparatus, according to claim 1, including an adjusting assembly extending between said longitudinally extending ramps for adjusting the spacing between the ramps.

4. Tilting lift apparatus, according to claim 1, wherein said pivotal leg assembly includes a tilter leg assembly having an upper end pivotally mounted to one of said ramps and a lower ground engaging end, a lock bar extending outwardly from said tilter leg assembly adjacent said lower ground engaging end and a brace having a first end and a second end, said brace bring pivotally mounted on said ramp adjacent said first end, said brace defining a notch adjacent said second end, whereby when said ramp is moved to such generally level position said tilter leg assembly moves to a vertical position and said notch of said brace receives said lock bar of said tilter assembly.

5. Tilting lift apparatus, according to claim 4, wherein each of said ramps defines a slot and a first end of a brace extends upwardly through each of said slots when said tilter leg assembly is in such vertical position.

6. Tilting lift apparatus, according to claim 4, including a chain mounted adjacent said lower ground engaging end of said tilter leg assembly for manually moving said tilter leg assembly away from said vertical position.

7. Tilting lift apparatus comprising a base unit having an upper transverse pivot shaft assembly, a pair of spaced and longitudinally extending ramps mounted on said pivot shaft assembly and movable between an angle position and a generally level position, each of said ramps having a fixed leg assembly at one end and a pivotable leg assembly at the other end, said pivotable assembly including a brace having a first end and a second end, said brace being pivotally mounted, one of said ramps defining a slot for receiving said first end of said brace when said pivotable leg assembly is moved to a vertical position, cross members extending between said ramps and a movement attenuating assembly comprising a cylinder connected to one of said ramps, said cylinder having a fluid point input port and fluid output port, a separate gravity feed fluid reservoir in communication with said ports, said ports having restricted passageways whereby when a force is placed on said cylinder by movement of said ramps, fluid is restricted through said passageways thereby slowing the movement of said ramps.

8. Tilting lift apparatus, according to claim 7, including an adjustment rod assembly extending between said ramps for adjusting the spacing of said ramps.

9. Tilting lift apparatus, according to claim 7, wherein said pivotable leg assembly includes a tilter leg assembly having an upper end pivotally mounted to one of said ramps and a lower ground engaging end, a lock bar extending outwardly from aid tilter leg assembly adjacent said lower ground engaging end and a brace having a first end and a second end, said first end pivotally mounted to said ramp, said brace having a recess adjacent said second end, whereby when said ramp is moved to such generally level position said tilter leg assembly moves to a vertical position and said recess of said brace receives and secures said lock bar of said tilter assembly.

10. Tilting lift apparatus, according to claim 9, wherein each of said ramps defines a slot and said first end of said brace extends through said slot when said tilter leg assembly is in such vertical position.

* * * * *